United States Patent [19]

Stein

[11] 4,172,652

[45] Oct. 30, 1979

[54] VAPORIZER FOR GENERATING DEVELOPER GAS, CONTAINING AMMONIA GAS, FROM AQUEOUS AMMONIA FOR DEVELOPING DIAZO COPYING MATERIAL

[75] Inventor: Eckehard Stein, Frankfurt, Fed. Rep. of Germany

[73] Assignee: Hoechst Aktiengesellschaft, Frankfurt am Main, Fed. Rep. of Germany

[21] Appl. No.: 872,675

[22] Filed: Jan. 26, 1978

[30] Foreign Application Priority Data

Jan. 29, 1977 [DE] Fed. Rep. of Germany ... 7702598[U]

[51] Int. Cl.[2] ..... G03D 7/00

[52] U.S. Cl. ..... 354/300; 159/13 A

[58] Field of Search ..... 354/299, 300; 159/13 A, 159/16 R, 16 S, 23

[56] References Cited

U.S. PATENT DOCUMENTS 3,849,232 11/1974 Kessler et al. ..... 159/13 A 4,003,069 1/1977 Hilgers ..... 354/299

4,062,031 12/1977 Schroter ..... 354/299

*Primary Examiner*—L. T. Hix

*Assistant Examiner*—Alan Mathews

*Attorney, Agent, or Firm*—James E. Bryan

[57] ABSTRACT

The invention relates to a vaporizer for generating developer gas, containing ammonia, from aqueous ammonia for developing diazo copying material, comprising a rectifying column with a transfer section, a substantially closed column head with a cover plate and a base plate, a first connecting branch for taking off the developer gas and a second connecting branch for feeding in aqueous ammonia opening into the column head, and a heated, steam-generating sump vessel at the foot of the transfer section, which includes a weir for liquids, which is located in the column head between the cover plate and the base plate below the connecting branches but above the transfer section, extends substantially over the entire cross-sectional area and has at least one passage orifice for liquid and at least one passage orifice for vapor.

8 Claims, 4 Drawing Figures

VAPORIZER FOR GENERATING DEVELOPER GAS, CONTAINING AMMONIA GAS, FROM AQUEOUS AMMONIA FOR DEVELOPING DIAZO COPYING MATERIAL

This invention relates to a vaporizer for generating developer gas, containing ammonia gas, from aqueous ammonia for developing diazo copying material.

A vaporizer of this type is provided in a copying apparatus, which does not produce effluent, for diazo-type materials as a vaporizer located outside a developing chamber. The vaporizer is composed of a distillation boiler with a heater winding and a rectifying column which is packed with packing and has a column head. The distillation boiler is located at the foot of the rectifying column and serves as a sump vessel. The column head is connected to a feed line for aqueous ammonia solution. The aqueous ammonia solution fed in flows downwardly into the rectifying column countercurrently to a steam flow generated in the distillation boiler. Thus, mass transfer takes place between the countercurrent flows so that developer gas which contains ammonia gas and has a relatively high ammonia content can be taken off at the column head, while the residual water flowing into the distillation boiler now only has a comparatively low ammonia content. This vaporizer operates in accordance with the principle of continuous rectification. In this context, it is also known to pass the residual water collecting in the distillation boiler to a likewise heated volatilizer and to discharge the residual water volatilized therein from the copying apparatus together with the exit air. (German Utility Model No. 73 14 454)

In an actual blueprinting machine (Type PA 941 blueprinting machine from KALLE, Division of Hoechst AG), a vaporizer which in principle is constructed as the vaporizer described above, is located as a second vaporizer outside the developing chamber, while there is a first vaporizer within the developing chamber. In this case, the vaporizer located outside, though fundamentally operating by the same principle, does not use fresh aqueous ammonia but, instead, the aqueous ammonia which has been discharged from the developing chamber and is already largely spent, is fed into the column head together with the condensate formed in the developing chamber. In this design, the transfer section of the rectifying column is not composed of a vessel packed with packing but, instead, of a coiled pipe. In thise case, the mass transfer takes place in the liquid film flowing down on the inner wall of the pipe. This rectifying column is thus also called a falling film vaporizer.

In vaporizers of this type, whether they are now provided as a single outside vaporizer or as a second vaporizer in addition to a vaporizer located in the developing chamber, there is a problem in that the permissible liquid load and gas load of such vaporizers is lower than in the case of other rectifying systems having a comparable free cross-section. These reduced loading capacities manifest themselves by, on the one hand, an increase in the thickness of the liquid film as the liquid rises, so that the mass transfer decreases, and, on the other hand, the gas loading in the column cross-section here increasing to such an extent that, in an extreme case, the rise in the gas velocity, thus resulting, leads to a destruction of the liquid film and to entrainment of the liquid in the gas stream so that the operation of the vaporizer is functionally unstable and no more than a limited separation of material is achieved. To avoid exceeding the loading limit in this way, there is the possibility of selecting a larger diameter of the pipe from which the coil is formed or to employ a packed column of larger diameter. This, however entails a larger constructional expenditure and a larger space requirement, and, furthermore, the necessary energy supply for generating the required steam flow can be increased. Such dimensions are above all uneconomical whenever the higher loading capacity of a vaporizer of this type is not fully utilized continuously. In the actual operation of the vaporizers running in conjunction with developing installations, however, the supply of liquid is irregular either because the fresh aqueous ammonia is metered, for example as a function of the required amount of developer gas or because spent aqueous ammonia and condensate, fed to the vaporizer, is formed in the developing chamber in fluctuating amounts.

It is thus the object of the present invention to provide a vaporizer of the generic type initially mentioned, which is distinguished by a greater loading capacity, the dimensions being the same and the construction of the rectifying column in the region of the transfer section and the heated, steam-generating sump vessel being the same. In particular, the vaporizer is intended to be able reliably and economically to process aqueous ammonia which has a fluctuating ammonia content and which is fed to the column head. The additional expense required for this purpose should be as low as possible.

With the aid of a weir for liquids, which is located in the column head between the cover plate and the base plate and which is heated by the stream of ammonia gas and water vapor leaving the transfer section, the aqueous ammonia held up in the weir is warmed and the ammonia contained in the aqueous ammonia is largely released. If, for example, aqueous ammonia which has an ammonia concentration of about 10 percent by weight of ammonia and which, for example, has left a developing chamber, is fed to the weir for liquids in the column head, a reduction to 3 to 4 percent by weight of ammonia takes place in the weir for liquids, when the latter is heated to a temperature of 90° by a mixture of ammonia gas and water vapor. The aqueous ammonia which is thus formed and has now only a slight ammonia content, represents a substantially smaller loading on the adjacent transfer section than that which would be effected by the aqueous ammonia flowing directly into the column head. Additionally, quantities of aqueous ammonia of different ammonia content are thoroughly mixed in the case where the ammonia concentration of the aqueous ammonia fed to the column head fluctuates, which can happen as the result of a fluctuating proportion of condensate in the residual aqueous ammonia which, together with condensate, leaves a developing chamber with an internal vaporizer. The aqueous ammonia flowing from the weir for liquids into the transfer section thus has a relatively constant ammonia content. It is, therefore, possible to construct the transfer section with little expense. In particular, in a transfer section which is built up with a coiled pipe, the pipe diameter can be kept relatively small so that the coil is relatively easy to fabricate. As a result, the dimensions of the transfer section also become relatively small. Finally, this vaporizer with the heated weir for liquids, which is provided according to the invention, does not require any additional energy because the vapor flow leaving the transfer section is utilized for heating the weir for liquids.

In a constructionally particularly simple manner the vaporizer is designed in such a way that the weir for liquids comprises an intermediate plate fixed to the inner wall of the column head and having at least one passage orifice for liquid with a raised edge and at least one passage orifice for vapor also with a raised edge which rises above the raised edge around the passage orifice for liquid. The edges rising above the intermediate plate thus form a hold-up step for the solution of aqueous ammonia flowing down onto the intermediate plate. The vapor stream of aqueous ammonia entering through the base plate fills the space formed between the intermediate plate and the base plate and warms the intermediate plate. The stream of gaseous vapor then can leave this space through the passage orifice for vapor in the intermediate plate and, in particular, due to the relatively high rise of the edge of this passage orifice, without having to overcome the resistance of the level of aqueous ammonia on the intermediate tray.

The mixture of ammonia gas and water vapor flowing through the passage orifice for gas, together with the components which have been vaporized from the aqueous ammonia on the intermediate tray, forms the developer gas. The latter is returned to the developing chamber.

Advantageously, the vaporizer also includes the features that the connecting branches for taking off the developer gas and for feeding in the aqueous ammonia are arranged in such a way that they are not in alignment with the passage orifices for liquids and the passage orifice for vapor. The result of this is that the mixture of ammonia gas and water vapor, flowing out of the passage orifice for vapor, is efficiently and thoroughly mixed with the gaseous vapor component produced from the aqueous ammonia on the intermediate tray, before the mixture leaves the connecting branch to the developing chamber. On the other hand, the aqueous ammonia fed into the column head cannot flow directly through the passage orifices for liquid to the transfer section, without being mixed on the intermediate tray with the mixture of ammonia and water present on the tray.

In a constructionally particularly simple manner the vaporizer is designed in such a way that the risers are composed of lengths of pipe which are fixed in the passage orifice for liquid and the passage orifice for vapor.

A design, which has proved particularly advantageous, for a vaporizer having a cylindrical column head has the features that there are four passage orifices for liquid in the intermediate plate, which orifices are located on a circle concentric to the imaginary central axis of the column head, that the passage orifice for gas is located outside this circle on the intermediate plate, that the connecting branch for feeding in is fitted into the wall of the column head at right angles to the lengths of pipe of the passage orifices for liquid and the passage orifices for gas and that the connecting branch for taking off the developer gas is located on the central axis of the column head. In this way, the intended effects of the column head with a weir for liquids are achieved to a high degree with a constructionally relatively simple design.

In an advantageous variant of the vaporizer, a coiled pipe is provided as the transfer section, which coiled pipe opens into the column head between the base plate and the intermediate plate. A coiled pipe forming a falling film vaporizer has proved particularly suitable as the transfer section. The column head with a weir for liquids, provided according to the invention, has an advantageous effect on the sizing of this pipe.

Appropriately, the open end of the coiled pipe is located in the base plate in such a way that it is in alignment with the passage orifice for vapor in the intermediate plate. In this way, the resistance, which the mixture of ammonia and water vapor flowing out of the pipe must overcome between the base plate and the intermediate plate, is kept relatively low. As a result, the weir for liquids has little effect on the head temperature. Appropriately, the head temperature is controlled, as is in itself known, by the arrangement of a temperature probe in the region of the gas exit branch in the stream of developer gas, which probe yields an actual temperature value which, after comparison with a set temperature value, feeds an electrical energy flow, appropriate to maintain the quantity of steam, to the heater device on the sump vessel.

In a particularly advantageous manner the vaporizer is designed with the feature that the rectifying column together with the entire column head and the coiled pipe is fabricated of chrome nickel steel. This embodiment is particularly safe in operation. The reason is that it is possible that no ammonia flows from the developing chamber into the column head of the vaporizer for a prolonged period so that the water collected in the sump vaporizes virtually completely and the sump vessel as well as the coiled pipe assume a relatively high temperature. If in this state of operation a new gush of aqueous ammonia enters the vaporizer, large temperature differences can easily occur and, with sensitive materials, these can lead to cracking of the vaporizer. With a construction of chrome nickel steel which is largely insensitive to aqueous ammonia, such a destruction is prevented.

In the following text, the invention will be further illustrated by reference to the accompanying drawings with four figures in which.

Figure 1:
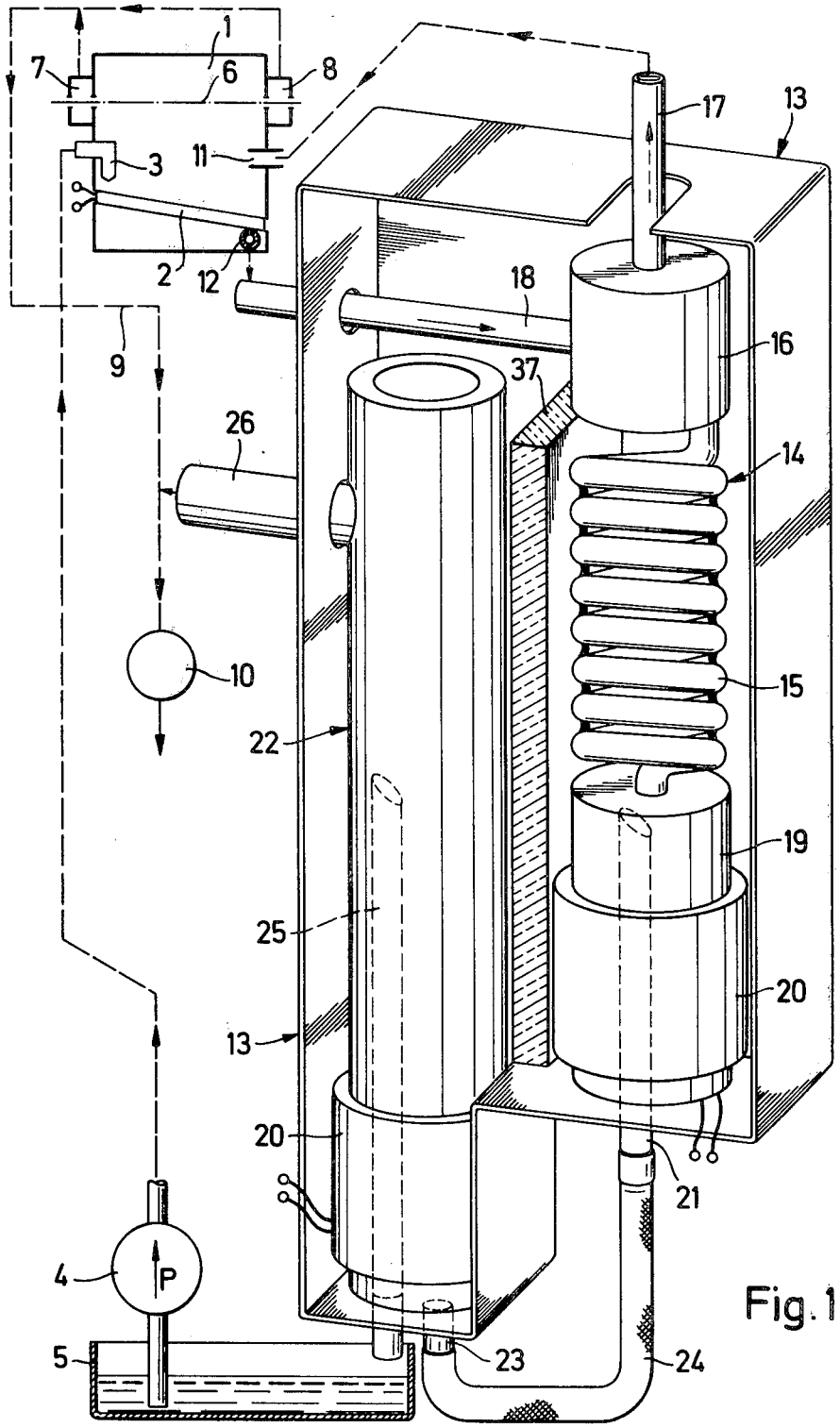
FIG. 1 shows, in a diagrammatic representation, the vaporizer together with a volatilizer in a casing which is connected to a developing chamber shown schematically.

In FIG. 1, 1 designates a developing chamber in which a heated inclined shute 2 is provided as an internal vaporizer. Fresh aqueous ammonia which is pumped from an aqueous ammonia container 5 by means of a metering pump 4, is passed onto the chute via a feed branch 3. Virtually fresh aqueous ammonia with about 25 percent by weight of ammonia is present in the aqueous ammonia container. Antechambers 7 and 8, from which a mixture of developer gas and air, being formed therein, is extracted via an extraction line 9 by means of an extractor fan 10, are located on the outside of the developing chamber on the transport path, indicated by the dashed-and-dotted line 6, for the diazo copying material.

An inlet branch 11 for developer gas is fitted on the developing chamber, for feeding in additional developer gas from an external vaporizer. At the lower end of the internal vaporizer, the cross-section of a take-off pipe 12 can be seen which is provided for taking off the largely spent aqueous ammonia from the internal vaporizer and the condensate arising in the developing chamber. The take-off pipe is also connected to the external vaporizer.

Figure 4:
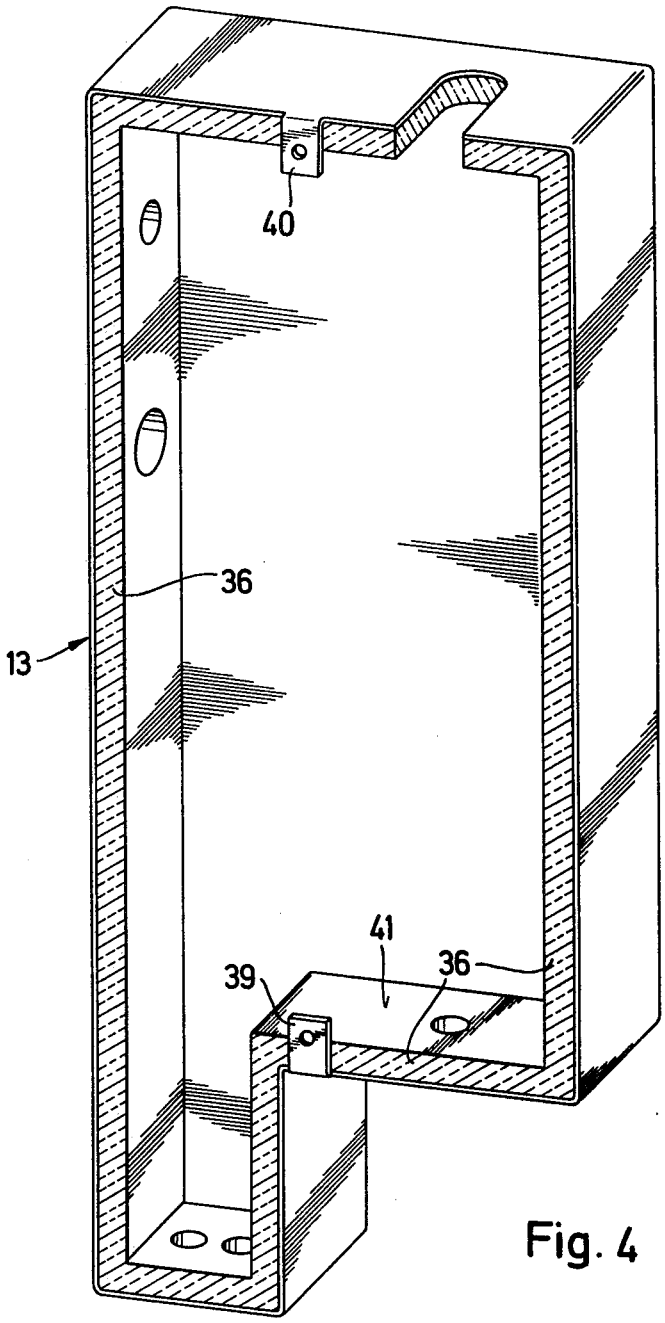
FIG. 4 shows the casing, lined with asbestos foam, for the vaporizer and volatilizer.

The external vaporizer 14 is accommodated in a steel casing 13 which is provided with an asbestos foam lining 36 and the design of which can be seen in detail in FIG. 4.

The vaporizer 14 comprises a rectifying column with a coiled pipe 15 as the transfer section. At the head of the transfer section, the column head 16 is located, of which a first connecting branch 17 for taking off the developer gas and a second connecting branch 18 for feeding largely spent aqueous ammonia into the column head can be seen in FIG. 1. The first connecting branch is connected to the inlet branch 11 for developer gas on the developing chamber and the second connecting branch is connected to the take-off pipe 12 of the developing chamber. Further details of the column head will be discussed below. At the foot of the transfer section there is a sump vessel 19 with a heater winding 20. The coiled pipe opens into this sump vessel. In the sump vessel, a connecting branch 21 for residual water projects upwardly so that the height of the orifice of this connecting branch above the base of the sump vessel determines the filling level, as long as sufficient liquid flows out of the coiled pipe.

The external vaporizer 14 can be regarded as having an essentially cylindrical shape. Parallel to this external vaporizer, a volatilizer 22 which also has a cylindrical shape is located inside the casing. The vaporizer 14 and the volatilizer 22 are separated inside the casing by a partition wall of asbestos foam 37, for the purpose of thermal insulation. Because the volatilizer is somewhat higher than the external vaporizer, the base of the common casing 13 is stepped in the manner of stairs. At its base, the volatilizer has an inlet branch 23 for residual water, which is connected via a low-lying residual water tubing 24 to the outlet branch for residual water of the external vaporizer and thus forms, together with the sump vessel, a syphon. In the volatilizer, an overflow branch 25 projects upwardly, the lower orifice of which opens into the aqueous ammonia container 5. The extraction line 9 is connected to an extraction branch 26 fitted into the wall of the volatilizer above the internal orifice of the overflow branch.

Figure 2:
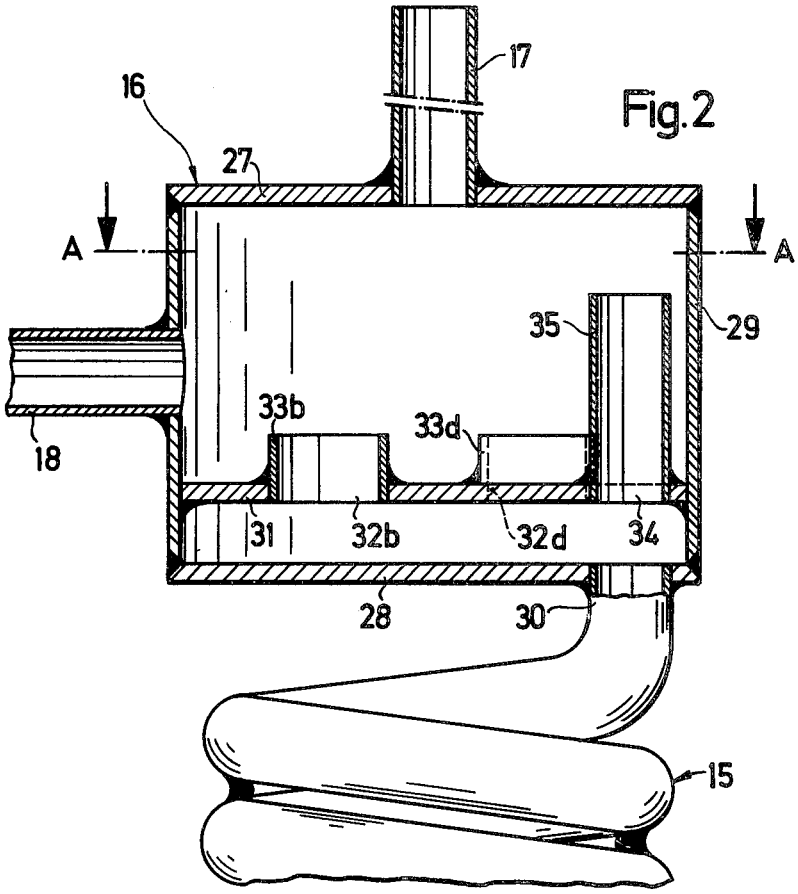
FIG. 2 shows the column head of the vaporizer in a longitudinal section.
Figure 3:
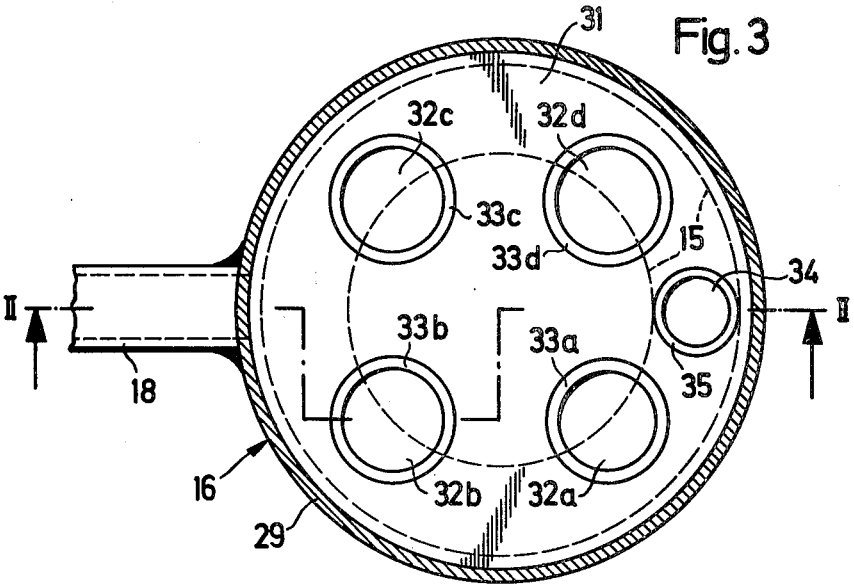
FIG. 3 shows the column head in a cross-section along the line A—A in FIG. 2.

The elements of the column head, which are essential to the invention, are shown in more detail in FIGS. 2 and 3. It can be seen from FIG. 2, that the column head 16 is made of welded construction and forms a substantially closed vessel with the cover plate 27 and the base plate 28, between which the cylindrical wall 29 is located. The column head is substantially closed, excepting the fixing point of the first connecting branch 17 in the center of the cover plate, the second connecting branch 18 in the cylindrical wall and the end piece 30 of the coiled pipe 15 in the base plate. In the interior, the column head has an intermediate plate 31 which is fixed to the cylindrical wall at a distance from the base plate. The intermediate wall is liquid-tight, excepting the passage orifices for liquid 32*a–d*. In the passage orifices for liquid, lengths of pipe 33*a–d* are fitted, the height of which determines the hold-up of aqueous ammonia on the intermediate tray. In the intermediate plate, there is also a passage orifice for vapor 34, into which a relatively high length of pipe 35 is fitted, the upper orifice of which is above the upper orifice of the lengths of pipe of the passage orifices for liquid. As shown in the drawing in accurate detail, four passage orifices for liquid are provided in the intermediate plate, which orifices are located on a circle concentric to the imaginary central axis of the column head. The passage orifice for gas 34 is located outside this circle on the intermediate plate. It is in alignment with the end piece 30 in the base plate 28.

With this design of the column head, a space is formed between the base plate and the intermediate plate for the mixture of ammonia gas and water vapor, which flows out of the end piece 30 when the external vaporizer is in operation and which heats the intermediate plate. The aqueous ammonia which is collected on the intermediate plate and has an already reduced concentration and which has flowed in an irregular quantity and concentration through the second connecting branch onto the intermediate plate and has been held up on the latter around the risers on the passage orifices for liquid, is warmed in this weir to approximately the temperature of the mixture of ammonia gas and water vapor. Consequently, the ammonia content of the aqueous ammonia mixture is considerably reduced in the weir for liquids by vaporization of the ammonia. The ammonia thus released is thoroughly mixed in the space between the cover plate 27 and the surface of the liquid with the mixture of ammonia gas and water vapor flowing out of the length of pipe 35 and leaves this space through the first connecting branch 17.

The residual water which leaves the foot of the coiled pipe 15 and which is virtually free from ammonia, normally is only partially vaporized in the sump vessel 19 to generate the rising stream of vapor necessary for mass transfer. The excess part of the residual water flows through the connecting tubing for residual water into the volatilizer 22 and is completely evaporated therein. The virtually ammonia-free steam thus generated is extracted through the extraction line 9. If under certain operating conditions, for example after the external vaporizer and the volatilizer have been switched off, residual condensate or aqueous ammonia is still flowing into the second connecting branch of the external vaporizer 14, this is taken up by the relatively large capacity of the volatilizer. If, furthermore, even more condensate and/or aqueous ammonia flows into the external vaporizer, the excess part even then cannot pass into the extraction line because it flows off via the overflow branch 25 into the aqueous ammonia container. This operating condition, however, is extremely rare so that virtually no dilution of the aqueous ammonia in the aqueous ammonia container occurs.

Between the orifice of the overflow branch 25, located in the volatilizer, and the extraction branch 26, there is a relatively large interspace which serves as a buffer zone for rising bubbles which under certain circumstances are formed during the elimination of residual water. Because of the buffer zone, no bubbles or liquid portions can pass into the extraction line in the present case.

FIG. 4 shows how the casing 13 is provided with a lining 36 of asbestos foam. The lugs 39, 40, each provided with a tapped hole, serve for fixing a lid, not shown. The step 41 is provided as a seat for the sump vessel 19.

It will be obvious to those skilled in the art that many modifications may be made within the scope of the present invention without departing from the spirit thereof, and the invention includes all such modifications.

What is claimed is:

1. A vaporizer for generating developer gas, containing ammonia, from aqueous ammonia for developing diazo copying material, comprising a rectifying column with a transfer section, a substantially closed column head with a cover plate and a base plate, a first connecting branch for taking off the developer gas and a second connecting branch for feeding in aqueous ammonia opening into the column head, and a heated, steam-generating sump vessel at the foot of the transfer section, which includes a weir for liquids, which is located in the column head between the cover plate and the base plate below the connecting branches but above the transfer section, extends substantially over the entire cross-sectional area and has at least one passage orifice for liquid and at least one passage orifice for vapor.

2. A vaporizer as claimed in claim 1 in which the weir for liquids comprises an intermediate plate fixed to the inner wall of the column head and having at least one passage orifice for liquid with a raised edge and at least one passage orifice for vapor also with a raised edge which rises above the raised edge around the passage orifice for liquid.

3. A vaporizer as claimed in claim 1 including an arrangement of the connecting branches for taking off the developer gas and for feeding in the aqueous ammonia such that they are not in alignment with the passage orifices for liquid and the passage orifice for vapor.

4. A vaporizer as claimed in claim 3 which includes risers composed of lengths of pipe which are fixed in the passage orifice for liquid and the passage orifice for vapor.

5. A vaporizer, having a cylindrical column head, as claimed in claim 2 which includes four passage orifices for liquid provided in the intermediate plate, which orifices are located on a circle concentric to the imaginary central axis of the column head, the passage orifice for vapor being in an arrangement offset thereto on the intermediate plate, the connecting branch for feeding in the aqueous ammonia being fitted into the inner wall of the column head at a right angle to the lengths of pipe of the passage orifices for liquid and the passage orifice for vapor, and the connecting branch for taking off the developer gas being located on the central axis of the column head.

6. A vaporizer as claimed in claim 1 which comprises a coiled pipe constituting the transfer section, which coiled pipe opens into the column head between the base plate and the intermediate plate.

7. A vaporizer as claimed in claim 6 including an end piece of the coiled pipe in the base plate and the passage orifice for vapor in the intermediate plate being arranged in mutual alignment.

8. A vaporizer as claimed in claim 7 in which the vaporizer with the column head and the coiled pipe are fabricated of chrome nickel steel.

* * * * *